US005193461A

United States Patent [19]

Theurer et al.

[11] Patent Number: 5,193,461

[45] Date of Patent: Mar. 16, 1993

[54] TIE EXCHANGE MACHINE WITH A TIE EXCHANGE DEVICE WHICH BOTH REMOVES OLD TIES AND INSERTS NEW TIES

[75] Inventors: Josef Theurer, Vienna; Herbert Wörgötter, Linz, both of Austria

[73] Assignee: Franz Plasser Bahnbaumaschinen-Industriegesellschaft m.b.H., Vienna, Austria

[21] Appl. No.: 719,771

[22] Filed: Jun. 24, 1991

[30] Foreign Application Priority Data

Aug. 24, 1990 [AT] Austria ..... 1743/90

[51] Int. Cl.[5] ..... E01B 29/10

[52] U.S. Cl. ..... 104/7.1; 104/9

[58] Field of Search ..... 104/2, 4, 5, 9, 7.1

[56] References Cited

U.S. PATENT DOCUMENTS

| | | | |
|---|---|---|---|
| 4,579,060 | 4/1986 | Nameny et al. | 104/9 |
| 4,794,861 | 1/1989 | Theurer et al. | 104/2 |
| 4,829,907 | 5/1989 | Theurer et al. | 104/5 |
| 4,884,509 | 12/1989 | Theurer et al. | 104/9 |
| 4,955,301 | 9/1990 | Theurer et al. | 104/7.2 |

FOREIGN PATENT DOCUMENTS 0057128 5/1984 European Pat. Off. .

*Primary Examiner*—Robert J. Oberleitner
*Assistant Examiner*—S. Joseph Morano
*Attorney, Agent, or Firm*—Collard & Roe

[57] ABSTRACT

A machine for exchanging old ties of a railroad track for new ties comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, and a ballast scarifying device for clearing ballast at the tie exchange position. According to the invention, a mobile tie transporting crane is mounted on the machine for movement along the track towards and away from the tie exchange device, and a device is arranged below the machine frame for depositing the old ties pulled out of the track by the tie exchange device and the new ties transported by the crane, the tie exchange device having a side facing the tie depositing device and the tie transporting crane comprising a vertically adjustable boom and tie gripper affixed to the boom.

14 Claims, 1 Drawing Sheet

TIE EXCHANGE MACHINE WITH A TIE EXCHANGE DEVICE WHICH BOTH REMOVES OLD TIES AND INSERTS NEW TIES

BACKGROUND OF THE INVENTION

1. Field of the Invention

The present invention relates to a machine and a method for exchanging old ties of a railroad track for new ties, the track being comprised of two rails fastened to the ties defining cribs therebetween, which comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, a ballast scarifying device for clearing ballast at the tie exchange position, and a device for depositing the ties.

Throughout the specification and claims, the directional terms "transversely" and "longitudinally" refer to the direction with respect to the longitudinal extension of the track.

2. Description of the Prior Art

European patent No. 0 057 128, published Aug. 4, 1982, discloses a tie exchanging machine of this general type, which comprises a tie exchange device for pulling the old ties and inserting the new ties, a vertically adjustable excavator for clearing the ballast at the tie exchange site, a tie depositing device, a ballast storage bin, a ballast tamper, a ballast broom and a ballast plow. The tie depositing device facing one side of the tie exchange device is comprised of two parallel, horizontal and longitudinally extending roller conveyors. While one of the roller conveyors transports the new ties to the tie exchange device, the other conveyor transports the old ties from the tie exchange device. The tie exchange device is longitudinally displaceably mounted on the machine frame and moves the old ties to, and the new ties from, the respective roller conveyors, the ties being turned 90° between their transverse positioning at the tie exchange site and their longitudinal positioning on the roller conveyors. This turning of the ties and the required centering of the ties on the roller conveyors considerably complicates and slows the operation.

U.S. Pat. No. 4,955,301, dated Sep. 11, 1990, discloses a tie exchange train comprising a series of bridge-like machine frames coupled to each other and carrying different tie exchange devices longitudinally displaceably mounted on the machine frames. The old ties are removed by a tie exchange device at the front of the train and the new ties are inserted by a tie exchange device at the rear of the train. The tie exchange devices are arranged on a longitudinally extending auxiliary carrier which is longitudinally displaceable and has one end supported on the railroad track by an undercarriage while an opposite auxiliary carrier end is pivotally supported on the machine frame. The old ties are deposited from the tie exchange device withdrawing the old ties from the track on a conveyor band extending below the auxiliary frame. The conveyor band conveys the old ties from an end of the conveyor band adjacent the tie exchange device to an opposite conveyor band end where they are transferred to an ascending conveyor. The old ties collected on the ascending conveyor are conveyed to a storage area on top of the machine frame where the old ties are stacked. The stack of old ties is then removed by means of a mobile crane which is mounted on, and runs along, the train. The new ties are similarly, and in reverse order, conveyed to the tie exchange device which inserts the new ties in the track. This machine very efficiently exchanges ties in an assembly line mode while the train continuously advances along the track, groups of three or four adjacent ties being exchanged in this fashion. However, such a train is not useful when a smaller machine unit with a single tie exchange device for withdrawing and inserting ties is desired.

U.S. Pat. No. 4,794,861, dated Jan. 3, 1989, U.S. Pat. No. 4,829,907, dated May 16, 1989, and U.S. Pat. No. 4,884,509, dated Dec. 5, 1989, disclose tie exchange trains of the above-described type, including transport cars for the ties and a mobile tie loading and unloading crane which may be driven longitudinally along the track.

SUMMARY OF THE INVENTION

It is the primary object of this invention to provide a tie exchange machine of the first-described type with a structurally simplified tie depositing device operable in conjunction with a single tie withdrawing and inserting device for the rapid removal of the withdrawn old ties and delivery of the new ties to be inserted.

In a machine for exchanging old ties of a railroad track for new ties and which comprises a machine frame supported by undercarriages for mobility along the track, a longitudinally, vertically and transversely displaceable tie exchange device connected to the machine frame for laterally pulling the old ties out of the track and laterally inserting the new ties in the track at a tie exchange position, and a ballast scarifying device for clearing ballast at the tie exchange position, the above and other objects are accomplished according to one aspect of the invention with a mobile tie transporting crane mounted on the machine frame for movement along the track towards and away from the tie exchange device, and a device arranged below the machine frame for depositing the old ties pulled out of the track by the tie exchange device and the new ties transported by the crane, the tie exchange device having a side facing the tie depositing device and the tie transporting crane comprising a vertically adjustable boom and tie gripping means affixed to the boom.

A common tie depositing device for the old and new ties not only provides a particularly simple tie depositing structure for all the ties handled by the tie exchange device but also considerably simplifies the delivery of the new ties to the tie exchange device. This is due to the fact that, after an old tie has been deposited on the tie depositing device, the tie exchange device needs to be only slightly longitudinally displaced to receive the immediately adjacent new tie previously deposited on the tie depositing device. In addition, the arrangement of the present invention has the advantage that the old and new ties are deposited in their transverse position so that they need not be turned 90° in a time-consuming operation effected by an additional tie turning device, thus enhancing the operating capacity of the machine. Since the new ties are directly deposited by the tie transport crane on the tie depositing device by the boom and tie gripping means required in any event for the tie transport, no additional transport device for the new ties is required. Furthermore, little additional work is required for removing the old tie from the tie depositing device immediately a new tie has been adjacently deposited.

The crane may be displaceably mounted on the machine frame for moving along the track or the tie exchanging machine may further comprise a tie transport car coupled to the machine frame and the crane may be displaceably mounted on the tie transport car for moving along the track.

According to a preferred feature, the tie depositing device is arranged centrally with respect to the machine frame between the track ties, the machine frame defines an opening enabling the ties gripping means to pass therethrough, and the tie gripping means is rotatable about a vertical axis. This arrangement simplifies the handling of the old and new ties at the tie exchange device while in no way interfering with the function of the crane as a transport device for conveying the old ties to, and new ties from, tie transport cars coupled to the machine frame. Also, a time-consuming raising of the tie depositing device to an upper level of the machine frame is avoided, during which the device cannot cooperate with the tie exchange device for receiving an old tie or delivering a new tie.

According to another preferred feature, the tie depositing device is a vertically adjustable fork lift comprising two transversely spaced fork parts extending substantially parallel to the track rails and capable of receiving a plurality of the ties arranged adjacent each other and extending transversely to the fork parts. In this way, the fork lift needs to be raised only slightly to engage the fork parts with the underside of a tie to be deposited thereon, and the two transversely spaced fork parts will securely support the tie when it is gripped by the tie gripping means. No turning of the ties is required during this operation.

If the tie depositing device is arranged adjacent one of the undercarriages supporting an end of the machine frame on the track, the machine further comprises a tie transport car coupled to the machine frame end, and rails are mounted atop the machine frame end and the tie transport car for moving the crane along the track, the transport path of the crane will be short so that the new ties may be transported from the tie transport car to the tie depositing device rapidly while the old ties may be removed rapidly on the return trip of the crane.

Preferably, the crane is carried on a support having an end including a flat surface for storing the old and new ties. Without increasing structural costs, this will enhance the economy of the machine because it allows several ties to be transported in a single run of the crane.

According to another preferred embodiment, the ballast scarifying device is arranged at a side of the tie exchange device opposite the side facing the tie depositing device and comprises vertically and transversely adjustable ballast clearing elements for clearing and planing the ballast in the cribs. This enables the ballast to be cleared and planed effectively and rapidly at the tie exchange site where the new tie is to be inserted while the old tie is deposited on the tie depositing device and the new tie is received therefrom by the tie exchange device.

If the ballast scarifying device is mounted on a carrier frame having opposite ends, and an undercarriage supports one of the carrier frame ends on the track adjacent the tie exchange device while the opposite carrier frame end is pivotally supported on the machine frame, the ballast scarifying device will be automatically centered in the cribs in sharp curves. Preferably, a drive is connected to the carrier frame for longitudinally displacing the carrier frame parallel to the track along a longitudinal displacement path so that the ballast may be immediately scarified at the tie exchange site after the old tie has been pulled out and without the need of moving the entire machine. This is accomplished without problems if the longitudinal displacement path corresponds at least to the distance between the planes of symmetry defined by the tie exchange and ballast scarifying devices.

According to yet another preferred embodiment, the machine further comprises a track lifting device mounted on the carrier frame adjacent the undercarriage supporting the one carrier frame end, the track lifting device comprising means for engaging the track rails and a lifting drive mounted on the machine frame for longitudinal displacement parallel to the track. In this arrangement, the track lifting device is automatically centered over the track rail to be engaged and lifted thereby, the longitudinal displacement of the lifting drive enabling the scarifying device to be longitudinally displaced without difficulty.

In the illustrated embodiment, one of the undercarriages supports an end of the machine frame on the track, the tie depositing device is arranged adjacent the one undercarriage on the machine frame, another one of the undercarriages supports an opposite end of the machine frame on the track, and the machine further comprises a vertically adjustable tamping head mounted on the machine frame between the opposite machine frame end and the ballast scarifying and tie exchanging devices. With this arrangement, it is possible to tamp the new tie immediately after its insertion in the track merely by slightly advancing the machine along the track until the tamping head is centered over the newly inserted tie.

According to a further simplified embodiment of the invention, the tie depositing device is transversely displaceable along a transverse displacement path which preferably corresponds substantially to the length of the ties. When the tie depositing device is transversely displaced, it need only be longitudinally moved after an old tie is pulled out of the track to deposit the old tie on the tie depositing device and the new tie need merely be gripped and transported longitudinally to the tie exchange site from which the old tie has just been pulled.

According to another aspect of the present invention, a method is provided for exchanging old ties of a railroad track for new ties, the track being comprised of two rails fastened to the ties defining cribs therebetween, which comprises the steps of sequentially laterally pulling one of the old ties out of the track at a tie exchange position, depositing the pulled old tie on a tie depositing device adjacent and parallel to a transversely extending new tie, transporting the new tie to the tie exchange position and laterally inserting the new tie in the track, and independently transporting to, and depositing on, the tie depositing device another transversely extending new tie and removing the old tie from the tie depositing device by moving a tie transporting crane along the track towards and away from the tie exchange device, the tie transporting crane comprising a vertically adjustable boom and tie gripping means affixed to the boom for gripping the new and old ties for transporting them.

This method enables the tie to be exchanged rapidly while being deposited on a common tie depositing device which cooperates with the tie gripping means on the crane boom. This rapid tie exchange is obtained because the conveyance and transport paths are of minimal length and the old ties are directly gripped by the transport crane at the tie depositing device and without having to be conveyed to a distant point.

BRIEF DESCRIPTION OF THE DRAWING

The above and other objects, advantages and features of this invention will become more apparent from the following description of certain now preferred embodiments thereof, taken in conjunction with the accompanying, somewhat schematic drawing wherein.

DETAILED DESCRIPTION OF PREFERRED EMBODIMENTS

Figure 1:
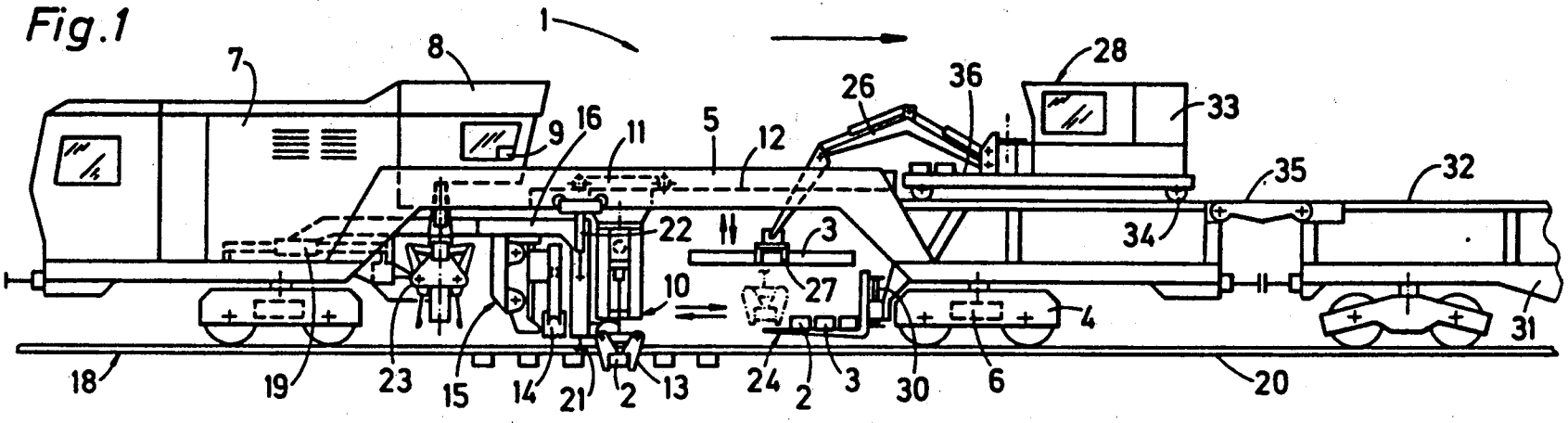
FIG. 1 is a side elevational view of a tie exchange machine according to the invention.
Figure 2:
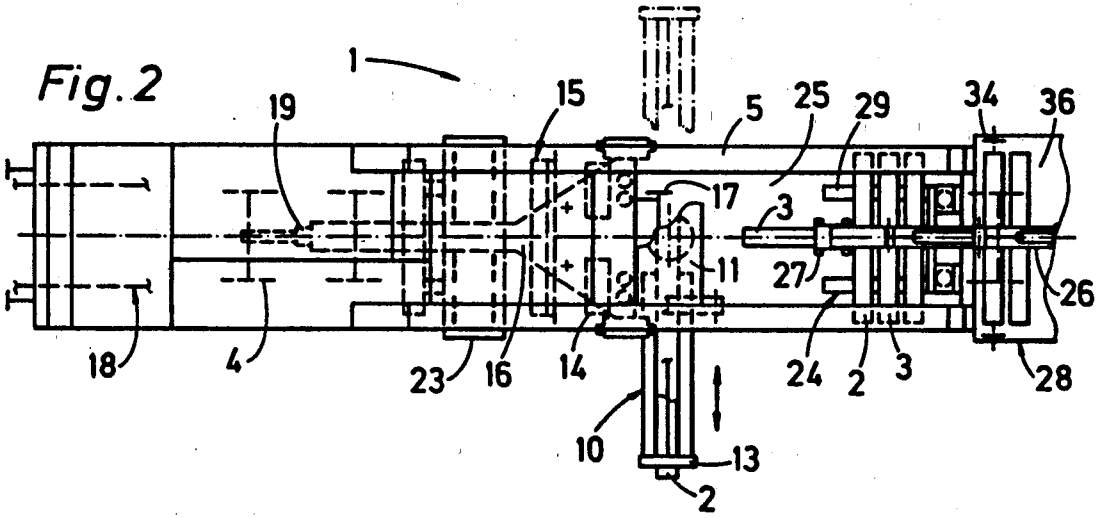
FIG. 2 is a simplified top view of FIG. 1.

Referring now to FIGS. 1 and 2, there is shown machine 1 for exchanging old ties 2 of railroad track 18 for new ties 3, the track being comprised of two rails 20 fastened to the ties defining cribs therebetween. The machine comprises machine frame 5 supported by undercarriages 4 for mobility along the track in an operating direction indicated in FIG. 1 by a horizontal arrow above the machine. Drive 6 propels the machine and the machine frame carries a central power plant supplying power to all the operating drives of the machine. Operator's cab 8 contains central control panel 9 and is mounted above, and within ready view of, the tie exchange site.

Longitudinally, vertically and transversely displaceable tie exchange device 10 is connected to machine frame 5 for laterally pulling old ties 2 out of track 18 and laterally inserting new ties 3 in the track at a tie exchange position. The tie exchange device is mounted for longitudinal displacement by drive 11 on longitudinally extending guide track 12 provided on machine frame 5. In the illustrated embodiment, the tie exchange device is suspended on the guide track by rollers engaging the guide track and the lower end of tie exchange device 10 carries a pair of pivotal clamps 13, 13 longitudinally spaced from each other for gripping a tie therebetween upon pivoting of the clamps, the gripping position of the clamps being illustrated in FIG. 1.

Machine 1 further comprises ballast scarifying device 15 for clearing ballast at the tie exchange position, which is arranged at a side of tie exchange device 10 opposite the side facing tie depositing device 24. The ballast scarifying device comprises vertically and transversely adjustable ballast clearing elements 14 for clearing and planing the ballast in the cribs. In the illustrated embodiment, a carrier frame 16 supports the ballast scarifying device, undercarriage 17 supporting one of the carrier frame ends on track 18 adjacent tie exchange device 10 while the opposite carrier frame end is pivotally supported on the machine frame. Drive 19 is connected to carrier frame 16 for longitudinally displacing the carrier frame parallel to the track along a longitudinal displacement path. The tie exchange device 10 and ballast scarifying device 15 define transversely extending planes of symmetry, and the longitudinal displacement path corresponds at least to the distance between the planes of symmetry.

The tie exchanging machine further comprises track lifting device 21 mounted on carrier frame 16 adjacent undercarriage 17 supporting the one carrier frame end, the track lifting device comprising means 21 for engaging track rails 20 and lifting drive 22 mounted on machine frame 5 for longitudinal displacement parallel to the track.

As shown, one undercarriage 4 supports an end of machine frame 5 on track 18, tie depositing device 24 is arranged adjacent the one undercarriage on the machine frame, another undercarriage 4 supports an opposite end of the machine frame on the track, and machine 1 further comprises vertically adjustable tamping head 23 mounted on machine frame 5 between the opposite machine frame end and the ballast scarifying and tie exchange devices 15, 10. The tamping head is arranged below operator's cab 8.

As shown, the machine further comprises mobile tie transporting crane 28 mounted on machine 1 for movement along track 18 towards and away from tie exchange device 10, and device 24 arranged below machine frame 5 for depositing old ties 2 pulled out of track 18 by tie exchange device 10 and new ties 3 transported by crane 28. Tie exchange device 10 has a side facing tie depositing device 24 and tie transporting crane 28 comprises vertically and transversely adjustable boom 26 and tie gripping means 27 affixed to the boom.

As best shown in FIG. 2, tie depositing device 24 is arranged centrally with respect to machine frame 5 between track rails 20, and machine frame 5 defines opening 25 enabling tie gripping means 27 to pass therethrough. Tie gripping means 27 is rotatable about a vertical axis.

The illustrated tie depositing device is a vertically adjustable fork lift, which may be slightly raised and lowered by drive 30 and comprises two transversely spaced fork parts 29 extending substantially parallel to track rails 20 and capable of receiving a plurality of the ties 2, 3 arranged adjacent each other and extending transversely to the fork parts.

In the illustrated embodiment, tie transport car 31 is coupled to the machine frame end adjacent to which tie depositing device 24 is arranged. Car 31 receives, stores and transports ties 2 and 3. Transversely spaced rails 32 are mounted atop the machine frame end and tie transport car 31 for moving crane 28 on wheels 34 engaging rails 32 along track 18. To enable the crane to move from the rails atop the machine frame end to the rail atop the tie transport car, the rails are connected by detachable bridging rail elements 35. Crane 28 is self-propelled by drive 33 and is longitudinally displaceable along track 18 on machine 5 and tie transport car 31. The crane is carried on a flatbed support having an end supporting the crane and the support end includes flat surface 36 for storing the old and new ties.

Old ties 2 of railroad track 18 are exchanged for new ties 3 with machine 1 by the following sequential steps:

After old ties 2 have been detached from rails 20, track lifting device 21 is operated for slightly lifting the track rails off the ties and tie exchange device 10 is operated for laterally pulling one of the old ties 2 out of track 18 at a tie exchange position. Drive 11 is then operated to displace tie exchange device 10 towards tie depositing device 24 to deposit the pulled old tie on the tie depositing device adjacent and parallel to a transversely extending new tie 3. For this purpose, drive 30 is operated to raise tie depositing device 24 slightly until the pulled old tie is engaged by device 24 and comes to rest on it. Tie exchange device clamps 13 are then pivoted to release old tie 2 resting on device 24, and tie exchange device 10 is then slightly further advanced by drive 11 until clamps 13 are centered over adjacent new tie 3, whereupon clamps 13 are pivoted into gripping engagement with the new tie, drive 11 is operated to transport the new tie to the tie exchange position by returning the tie exchange device thereto, and the tie exchange device laterally inserts the new tie in track 18. While the new tie is being inserted in the track, another transversely extending new tie 3 is independently transported to, and deposited on, tie depositing device 24 at the spot from which the old tie has been removed from the tie depositing device by moving tie transporting crane 28 along track 18 towards and away from the tie exchange device. In the removal of old tie 2 from device 24 and the transport of new tie 3 from support surface 36, tie gripping means 27 grips the tie, turns it 90° so that it may pass through opening 25 in machine frame 5 as vertically adjustable boom 26 respectively raises and lowers the tie to and from surface 36 on the flatbed support of crane 28, on which the ties are stored in a transversely extending position after the tie gripping means is turned back 90°. The tie gripping means transporting a new tie is also turned back 90° after is passes through opening 25 so that new ties 3 extend transversely on tie depositing device 24. After all the stored new ties 3 have been deposited on device 24 for insertion in the track and have been replaced on storage surface 36 by old ties 2, drive 33 is operated to move crane 28 to an adjacent tie transport car 31 where the old ties are deposited and new ties are placed on the storage surface by the crane.

Between the pulling of the old tie and insertion of the new tie at the tie exchange site, drive 19 is operated to displace carrier frame 16 longitudinally so as to center ballast clearing and planing elements 14 of ballast scarifying device 15 over the tie exchange site from which the old tie has been removed. The ballast clearing and planing elements are then lowered and transversely displaced to clear and plane the ballast, forming a groove which facilitates the subsequent insertion of a new tie at the tie exchange site. The tie exchange and ballast scarifying means and operations at the tie exchange site are conventional. During the entire tie exchange operation hereinabove described, machine 1 stands still. After this operation has been completed, the machine is slightly advanced in the operating direction until tamping heads 23 at each rail 20 are centered over the new tie inserted in track 18 for tamping the new tie. While the new tie is tamped, the above-described removal of old tie 2 and transport of new tie 3 by boom 26 and tie gripping means 27 may proceed unhindered.

Figure 3:
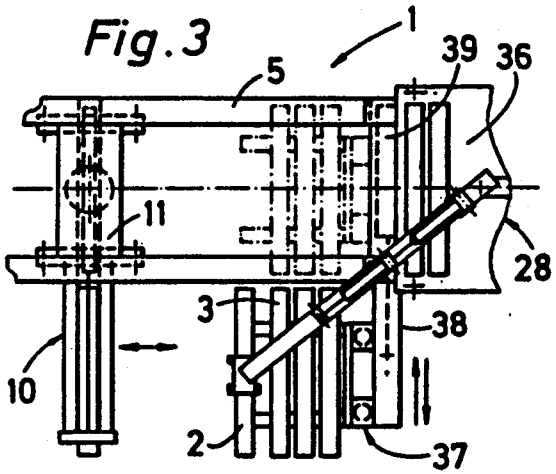
FIG. 3 is a fragmentary top view showing an embodiment of a transversely displaceable tie depositing device.

FIG. 3 shows an embodiment wherein tie depositing device 37 is transversely displaceable along a transverse displacement path which preferably corresponds substantially to the length of the ties. In the illustrated embodiment, the tie depositing device is affixed to telescopingly extensible and retractible transverse guide rail 38 mounted on machine frame 5, which may be extended and retracted by drive 39. In this manner, tie depositing device 37 may be transversely adjusted between a transit position centered with respect to machine frame 5 between the track rails (shown in phantom lines) and an operating position laterally adjacent the machine frame (shown in full lines). This embodiment has the advantage that all that is required for the tie depositing device to receive the pulled old tie from the tie exchange device and to transport the new tie thereto for insertion is to displace the tie depositing device longitudinally. New ties 3 are transported to laterally extended tie depositing device 37 and old ties 2 are removed therefrom simply by transversely pivoting crane boom 26, as shown in FIG. 3. This also avoids passing the ties through machine frame opening 25 and accordingly does away with the 90° turning of the ties.

What is claimed is:

1. A machine for exchanging old ties of a railroad track for new ties, the track being comprised of two rails fastened to the ties defining cribs therebetween, which comprises (a) a machine frame supported by undercarriages for mobility along the track, (b) a longitudinally, vertically and transversely displaceable tie exchange device connected to the machine frame for laterally pulling the old ties out of the track and laterally inserting the new ties in the track at a tie exchange position.

(c) a ballast scarifying device longitudinally displaceable to the tie exchange position for clearing ballast at the tie exchange position after the old ties have been pulled out of the track and before the new ties are inserted, (d) a tie depositing device arranged entirely below the machine frame for directly placing the old ties pulled out of the track by the tie exchange device parallel and adjacent to new ties to be inserted in the track, the tie exchange device having a side facing the tie depositing device and including clamping means for directly removing the new ties for insertion, and (e) a mobile tie transporting crane mounted on the machine for movement along the track towards and away from the tie depositing device for depositing new ties on the tie depositing device and removing old ties therefrom.

2. The tie exchanging machine of claim 1, wherein the crane is displaceably mounted on the machine frame for moving along the track.

3. The tie exchanging machine of claim 1, further comprising a tie transport car coupled to the machine frame, the crane being displaceably mounted on the tie transport car for moving along the track.

4. The tie exchanging machine of claim 1, wherein the tie depositing device is a vertically adjustable fork lift comprising two transversely spaced fork parts extending substantially parallel to the track rails and capable of receiving a plurality of the ties arranged adjacent each other and extending transversely to the fork parts.

5. The tie exchanging machine of claim 1, wherein one of the undercarriages supports an end of the machine frame on the track, the tie depositing device is arranged adjacent the one undercarriage on the machine frame, and further comprising a tie transport car coupled to the machine frame end, and rails mounted atop the machine frame end and the tie transport car for moving the crane along the track.

6. The tie exchanging machine of claim 1, further comprising a support having an end supporting the crane, the support end including a flat surface for storing the old and new ties.

7. The tie exchanging machine of claim 1, wherein the ballast scarifying device is arranged at a side of the tie exchange device opposite the side facing the tie depositing device and comprises vertically and transversely adjustable ballast clearing elements for clearing and planing the ballast in the cribs.

8. The tie exchanging machine of claim 7, further comprising a carrier frame for the ballast scarifying device, the carrier frame having opposite ends, and an undercarriage supporting one of the carrier frame ends on the track adjacent the tie exchange device, the opposite carrier frame end being pivotally supported on the machine frame.

9. The tie exchanging machine of claim 8, further comprising a drive for longitudinally displacing the carrier frame parallel to the track along a longitudinal displacement path.

10. The tie exchanging machine of claim 9, wherein the tie exchange and ballast scarifying devices define transversely extending planes of symmetry, and the longitudinal displacement path corresponds at least to the distance between the planes of symmetry.

11. The tie exchanging machine of claim 8, further comprising a track lifting device mounted on the carrier frame adjacent the undercarriage supporting the one carrier frame end, the track lifting device comprising means for engaging the track rails and a lifting drive mounted on the machine frame for longitudinal displacement parallel to the track.

12. The tie exchanging machine of claim 1, wherein one of the undercarriages supports an end of the machine frame on the track, the tie depositing device is arranged adjacent the one undercarriage on the machine frame, another one of the undercarriages supports an opposite end of the machine frame on the track, and further comprising a vertically adjustable tamping head mounted on the machine frame between the opposite machine frame end and the ballast scarifying and tie exchanging devices.

13. The tie exchanging machine of claim 1, wherein the depositing device is transversely displaceable along a transverse displacement path.

14. The tie exchanging machine of claim 13, wherein the transverse displacement path corresponds substantially to the length of the ties.

* * * * *